United States Patent [19]

McAninch et al.

[11] Patent Number: 4,936,371

[45] Date of Patent: Jun. 26, 1990

[54] MOLTEN METAL SAMPLING, WAVE DAMPING, FLAKE REMOVAL AND MEANS FOR COLLECTING AND FORWARDING FLAKES FOR COMPOSITION ANALYSIS

[75] Inventors: William D. McAninch, Allegheny Township, Armstrong County; Michael L. Ruschak, Sewickley Township, Allegheny County; Daniel A. Anderson, Greensburg; Andrew Antoninka, Lower Burrell; William C. Craig, Apollo; John L. Genna, Monroeville, all of Pa.

[73] Assignee: Aluminum Company of America, Pittsburgh, Pa.

[21] Appl. No.: 288,914

[22] Filed: Dec. 23, 1988

[51] Int. Cl.[5] ..... B22D 11/16; B22F 9/00

[52] U.S. Cl. ..... 164/4.1; 164/150; 164/154; 164/452; 264/8; 425/8

[58] Field of Search ..... 164/46, 423, 463, 452, 164/4.1, 150, 154; 264/5, 8; 425/6, 8; 436/73; 73/61 LM

[56] References Cited

U.S. PATENT DOCUMENTS

| | | | |
|---|---|---|---|
| 3,838,185 | 9/1974 | Maringer et al. | 164/463 |
| 3,904,344 | 9/1975 | Maringer et al. | 164/463 |
| 3,908,745 | 9/1975 | Caldwell et al. | 164/463 |
| 4,154,284 | 5/1979 | Maringer | 425/8 |
| 4,170,257 | 10/1979 | Pond, Sr. et al. | 164/463 |
| 4,242,069 | 12/1980 | Maringer | 425/8 |
| 4,385,013 | 5/1983 | Couling et al. | 425/8 |
| 4,783,417 | 11/1988 | Genna | 73/61 LM |

FOREIGN PATENT DOCUMENTS

| | | | |
|---|---|---|---|
| 1455705 | 11/1976 | United Kingdom | 164/423 |

OTHER PUBLICATIONS

*Metals Handbook*, Desk Edition, ASM, 1985, p. 13.2.

*Primary Examiner*—Nicholas P. Godici
*Assistant Examiner*—Edward Brown
*Attorney, Agent, or Firm*—Elroy Strickland

[57] ABSTRACT

A method and apparatus for making metal flakes from a body or stream of molten metal. The apparatus includes a wheel with serrations on its periphery, and means for rotating the wheel in a vertical plane. Means are provided for controlling the relative positions of the wheel and the upper surface of the body of molten metal which is subjected to change. In this manner, the serrations on the bottom of the wheel are disposed a preselected distance into the body of molten metal. When the serrations rotate out of the body, molten metal collects on the serrations and freezes into solid flakes. Means are provided for removing the flakes from the serrations and for collecting the flakes at one location on the periphery of the wheel.

23 Claims, 3 Drawing Sheets

MOLTEN METAL SAMPLING, WAVE DAMPING, FLAKE REMOVAL AND MEANS FOR COLLECTING AND FORWARDING FLAKES FOR COMPOSITION ANALYSIS

BACKGROUND OF THE INVENTION

The present invention relates generally to sampling a body of molten metal for analysis purposes, and particularly to a method and apparatus for controlling the depth of a sampling wheel in a molten body or stream of metal that experiences changes in elevation in the upper surface of the body or stream.

Patent application Ser. No. 826,988, filed Feb. 7, 1986 now U.S. Pat. No. 4,783,417, issued Nov. 8, 1988, discloses a system in which the teeth of a serrated wheel are rotated in a source of molten metal to provide solid metal flakes, and apparatus in which the flakes are analyzed for elements of the composition of the metal of the molten source. The system, in addition, provides physical separation of the analytical apparatus from the harsh environment of the molten source. In this manner, the flakes formed at the location of the source by the serrated wheel are analyzed at a substantial distance from the source, the flakes being transported to the analysis apparatus by a gas stream flowing through a tube or conduit extending between the wheel and the analysis apparatus. Such a system and procedure allows analysis of molten metal before and during casting so that its alloy composition can be changed if required.

A problem encountered in using a sampling wheel in a body of molten metal is locating and maintaining the peripheral teeth of the wheel a precise depth in the molten body when the elevation of the upper surface of the body changes. If the lower teeth of the wheel are too deep in the molten metal, the wheel produces a wire of solidified metal, as opposed to particles or flakes. If the serrations do not enter the metal at a sufficient depth, an insufficient amount of metal adheres to the serrations such that an insufficient amount of particles is produced for sampling.

Changes occurring in the elevation of the molten surface can be gradual or abrupt. Gradual changes occur as filters, used to maintain the purity of the metal to be cast, become clogged, or when the head of the molten metal is changed at the casting apparatus, for example. Abrupt changes in the level of the metal in a casting trough can occur when a pouring operation begins, i.e., when metal is poured from a furnace that supplies the casting process with the molten metal. Pouring is effected by tilting the furnace, the angle of the tilt, and the rate of pour, being controlled by sensors that sense the level of metal in a pouring trough. The control effected by the sensors can cause an oscillating movement of the pouring process that causes waves in the upper level of the molten metal to be sampled.

SUMMARY OF THE INVENTION

What is therefore needed, and which constitutes a primary objective of the invention, is to provide means for controlling the relative positions of the sample wheel and the elevation of the upper surface of the molten metal so that the bottom serrations of the wheel are disposed in the molten metal a preselected depth for the sampling process. In this manner, the serrations produce flakes of solid metal of proper size and configuration for analysis.

Gradual changes in the level of the molten stream are followed by disposing the wheel into and removing the wheel from the stream in a repeated manner. Abrupt changes and waves in the upper surface of the molten metal are dampened by a structure that forms a small quiescent body of molten metal within the larger stream (that experiences the waves) so that the serrations of the wheel can (again) rotate in the metal at a proper depth. The preferred dampening means, as discussed in detail hereinafter, also presents fresh metal to the wheel so that sampling is not limited to one portion of the totality of the larger body or stream of the molten metal.

A further objective of the invention is to remove sample flakes from the wheel at one location on the periphery of the wheel. This is effected by a high velocity gas stream directed perpendicularly to the serrations. The removal preferably takes place in a housing disposed closely adjacent to and about the serrations so that the flakes removed by the gas stream are received in the housing.

Yet another objective of the invention is to transport the particles adhering to the serrations of the wheel rapidly to apparatus remotely located for analyzing the flakes. The objective is to provide "real time" compositional analysis of the metal of the molten body or stream, real time referring to monitoring a process as it occurs so that the monitoring results are obtained without undue delay. This is effected by use of a gas stream pulled through a transport tube connected between the housing located about the serrations and the analyzing apparatus such that the flakes are drawn from the wheel into the housing and from the housing into the transport tube.

THE DRAWINGS

The invention, along with the objectives and advantages, will be best understood from consideration of the following detailed description and the accompanying drawings in which.

PREFERRED EMBODIMENT

Figure 1:
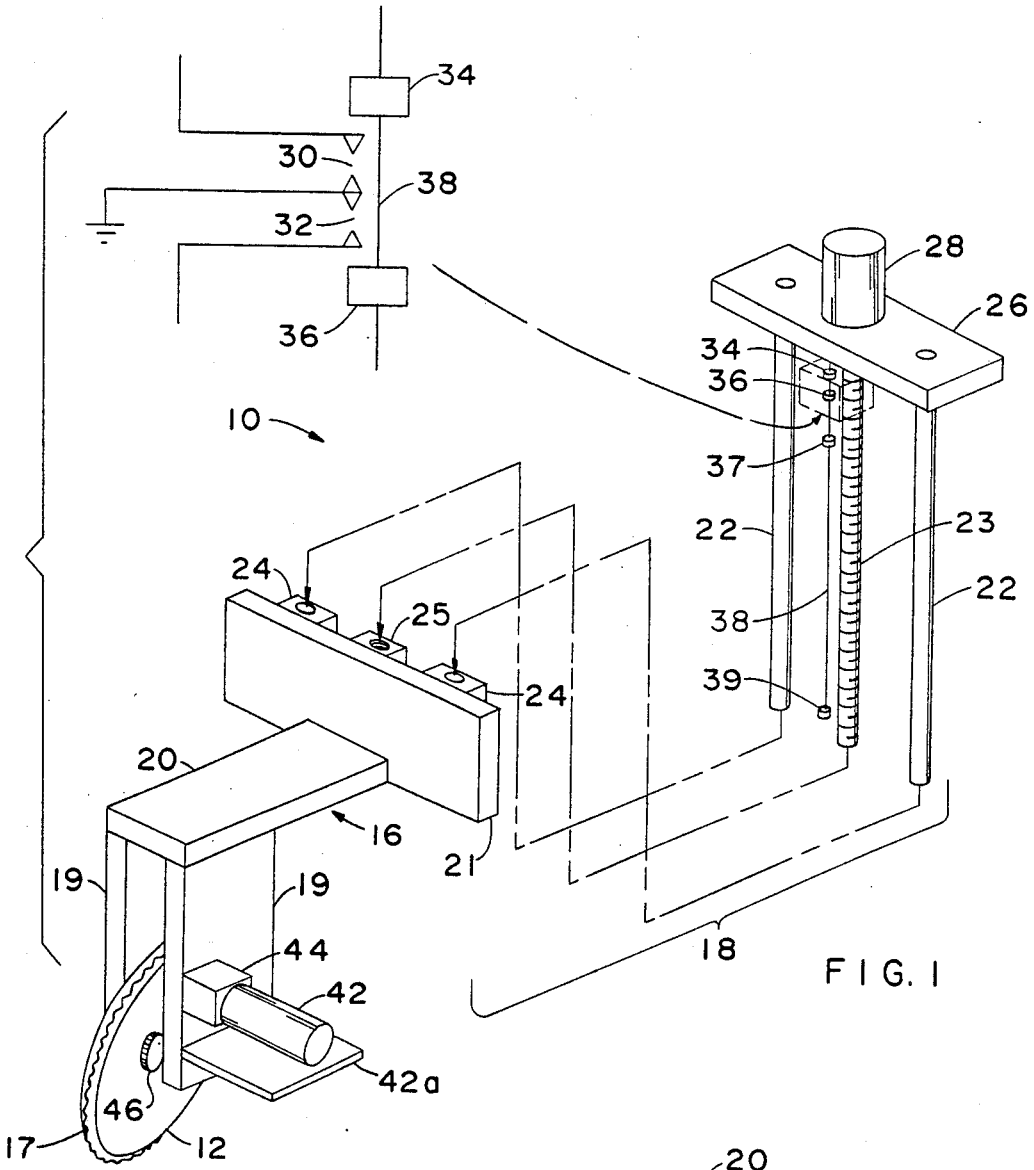
FIG. 1 is an exploded view of the sampling wheel, wheel support structure and associated drive systems for disposing and rotating the wheel in a molten body of metal.

Referring now to the drawings, FIG. 1 thereof shows diagrammatically mechanisms 10 for translating a sampling wheel 12 to and from a molten source of metal 14 (FIG. 2), and for rotating the wheel in a vertical plane. The source of molten metal can be a stream of the metal flowing through a casting trough 15. Serrations 17 are provided on the periphery of the wheel for sampling the metal of molten source 14. The wheel is suspended from a platform structure 16 that permits the wheel to be mechanically attached to a Thompson slide system 18.

Platform 16 comprises two vertically extending, parallel wall structures 19 depending from an upper horizontal plate 20. Wheel 12 is rotatably supported between depending structures 19. Plate 20 is, in turn, mounted on the front face of an upright panel 21.

Slide system 18 comprises two vertically disposed, parallel guide bars 22 and a rotatable threaded shaft 23 located between and parallel to the bars, all secured to an upper platform 26. The bars and threaded shaft extend through respective bosses 24 and 25 located on the rear side (in FIG. 1) of panel 21 of platform structure 16. Boss 25 has internal threads that mate with external threads of shaft 23. A stepping motor 28 is mounted on platform 26 and connected to the threaded shaft to rotate the same and thereby lower and raise platform structure 16 and sampling wheel 12. The rotation of motor 28 is therefore reversible and is of the type that operates in the range one to 1000 steps per second, the threaded shaft providing each step with a corresponding 0.0005 inch increment of vertical movement. It can be appreciated that such a motor and shaft is highly effective in rapidly and precisely positioning the serrations of wheel 12 in a molten body of metal. A commercially available motor that has been found suitable for this purpose is a Slo-Syn stepping motor no. M092-FD08.

Total vertical travel of the wheel and its platform structure is limited by two micro switches 30 and 32 (schematically shown in the upper portion of FIG. 1) having two blocks 34 and 36 to respectively trigger the switches, and two stops 37 and 39. The stops and trigger blocks are located on a thin shaft 38, the stops being located adjacent the upper and lower ends respectively of the shaft. The shaft is spring-mounted to and beneath motor platform 26, and extends generally parallel to shafts 22 and 23. If motor 28 translates wheel platform 16 downwardly to the vertical position of lower stop 39, the boss 25 on the back side of panel 21 engages the lower stop and pulls shaft 38 downwardly until the trigger 34 of upper switch 30 engages and closes the upper switch. This signals a microprocessor 40 (FIG. 3) to raise wheel platform 16. The microprocessor orders the supply of an operating voltage to motor 28, the motor raising platform 16 until boss 25 engages upper stop 37. The engagement of 37 pulls shaft 38 upwardly until the trigger 36 of lower switch 32 closes the switch. The closing of switch 32 signals the microprocessor to stop operation of motor 28.

Wheel 12 is rotated by a motor 42 under control of microprocessor 40. The motor is shown mounted on one of the depending walls 19 and offset from the horizontal axis of the wheel. Motor 42 rotates the wheel through a mounting block 44 and a gear 46 located on the wheel, at its axis of rotation, and on the side of the wheel facing motor 42. Gear 46 is driven by a gear 47 mechanically connected to the motor through block 44.

A heat insulating shield 42*a* is shown located beneath the motor to protect the same from the heat of molten metal 14.

Figure 2:
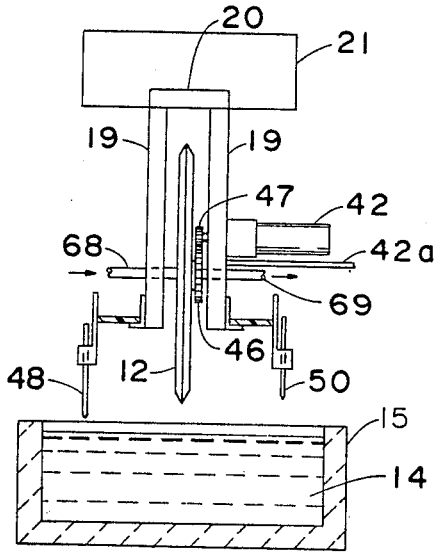
FIG. 2 is a front elevation view of the wheel and support structure of FIG. 1.
Figure 3:
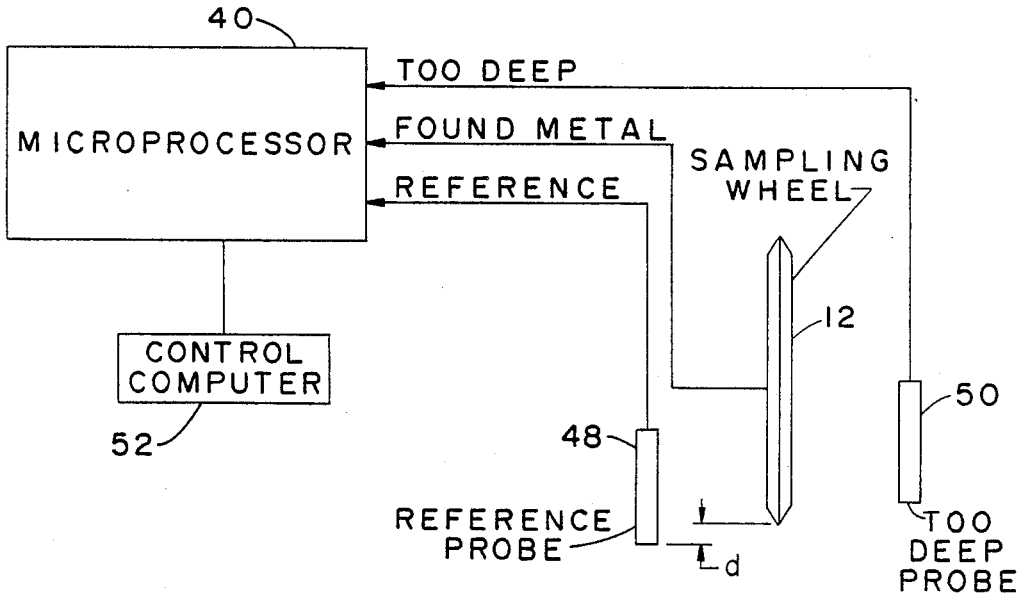
FIG. 3 is a schematic representation of the sampling wheel of FIG. 1, and electrodes for controlling the position of the wheel relative to the molten body of metal.

As shown schematically in FIG. 3, wheel 12, a reference probe 48 and a "too deep" probe 50 are electrically connected to microprocessor 40, and are physically attached to platform 16 (but electrically isolated from 16), as shown in FIG. 2. Still referring to FIG. 3, the lower end or tip of reference electrode 48 is slightly lower (of the order of one-half inch) than the lower edge of wheel 12, as indicated by letter d, such that the electrode will contact molten body 14 ahead of the wheel when platform 16 is lowered toward 14.

A low voltage potential is applied between the wheel and probe 48, and between probes 48 and 50.

To begin sampling of the metal of molten body 14, a main control computer 52, interfaced with microprocessor 40, instructs motor 28 (FIG. 1) to drive platform 16 toward the molten body and motor 42 to rotate the wheel. (When using the sampling process of the present invention with the analysis system disclosed in the above application Ser. No. 826,988, the use of two computers is preferred, i.e., one computer, microprocessor 40, is located at the site of the sampling process while a main control computer, computer 52, is located at the site of the analysis process. The two sites are separated from each other by a substantial distance, because of the harsh environment of the sampling site, such that the number of data bus lines extending between the two sites would be unduly large if a single computer was used to control both processes.) Translation of the platform is accomplished by motor 28 rotating threaded shaft 23 in a direction that lowers platform 16 along guide bars 22, and the threaded shaft, until probe 48 enters the stream or body of molten metal and the wheel makes contact with the molten stream. The electrical potential existing between the probe and wheel is applied to the molten stream when the probe contacts it. When the wheel contacts the molten stream current flows between the probe and wheel through the molten metal. This signals the computer that the wheel has found the upper surface of the molten stream.

Computer 52 is programmed to now move serrations 17 of the wheel into the molten stream a controlled depth, i.e., a depth that is slightly less than the depth of the teeth of serrations 17. For example, if the depth of the teeth is 0.080 inch, the lowermost tooth is disposed into stream 14 about 0.010 inch. The wheel is then held at this depth for a short, predetermined period of time, on the order of 100 milliseconds, for example, and then withdrawn from the stream so that electrical contact is broken between the wheel and pool. When continuity is broken, the computer senses this and orders return of the wheel into the molten stream to the programmed depth, holds the wheel in the metal for the above short period of time, and then again withdraws the wheel. This sequence of events is repeated so that the wheel can follow gradual changes occurring in the level of the molten stream, and thereby be precisely immersed for the sampling process. The size and shape of the flakes are controlled by the size of serrations 17, the distance at which the serrations are immersed in the molten stream and the physical properties of the metal being sampled. The small increments of movement provided to platform 16 by threaded shaft 23 and the frequency at which motor 28 steps is effective to translate the wheel into and out of the molten stream so that sampling is accomplished at a precise depth.

While the rotating wheel is disposed in the molten metal, the serrations of the wheel carry droplets of the metal from the molten metal, which droplets freeze on and adhere to the serrations to form flakes of metal. As explained earlier, if the serrations of the wheel are not deep enough in the molten metal, they will not produce a quantity of flakes sufficient for analysis. If the serrations are too deep in the molten body, the flakes that form on the serrations join together to form a continuous wire of metal that clogs the sample transport system (FIGS. 5 and 6) of the invention.

Still referring to FIGS. 2 and 3, the lower edge of the "too deep" probe 50 is higher than the lower edge of wheel 12 by about 0.060 inch. If the wheel enters molten stream 14 by an excessive amount, such that probe 50 makes contact with the molten stream, the low voltage potential applied between probes 48 and 50 causes electrical current to flow between them through the molten stream. This signals computer 52 to raise the wheel from the stream, and to keep the wheel in such raised position until the cause of excessive depth is corrected.

A suitable material for probes 48 and 50 is one that is electrically conductive, chemically inert in a molten metal, and heat resistant. In repeated testing of the apparatus of the present invention, titanium diboride ($TiB_2$) has been found to be an effective probe material in molten aluminum.

The material of wheel 12 is preferably copper, as copper is a good conductor of both heat and electrical current. Its heat conducting capability is employed to absorb the heat of molten metal droplets adhering to the serration of the wheel, as the wheel rotates out of molten pool 14, and then dissipate the heat. As explained above, the droplets solidify on the serrations to form small flakes of metal of a size and shape suitable for pneumatic transport and chemical analysis. In repeated tests of the system, as thus far described, aluminum alloy flakes provided by wheel 12 were transported 270 feet through a ¾ inch metal tube or pipe 54 (FIG. 6) to a cyclone device 56 (FIG. 6) in ten to twelve seconds, using a flow of gas in the tube. The gas flow was created by a vacuum pump 58 (FIG. 6) pulling twenty seven cu. ft./min. air at zero psig or 25 inches of mercury at zero air flow. The flakes were thus transported at a speed of about twenty five feet per second, with 99 to 100% efficiency, i.e., all of the flakes entering the tube were transported to the end of the tube at the cyclone.

The copper of wheel 12 oxidizes over time. Such oxidation has been found to cause the flakes collected on the serrations of the wheel to prematurely separate from the wheel as the serrations rotate out of the molten stream. In addition, the copper oxide resists the flow of current between the wheel and probe 48 when sensing the upper level of the stream. By coating the serrations of the wheel with a non-oxidizing noble metal, such as gold, the oxidation problem is averted.

Figure 4:
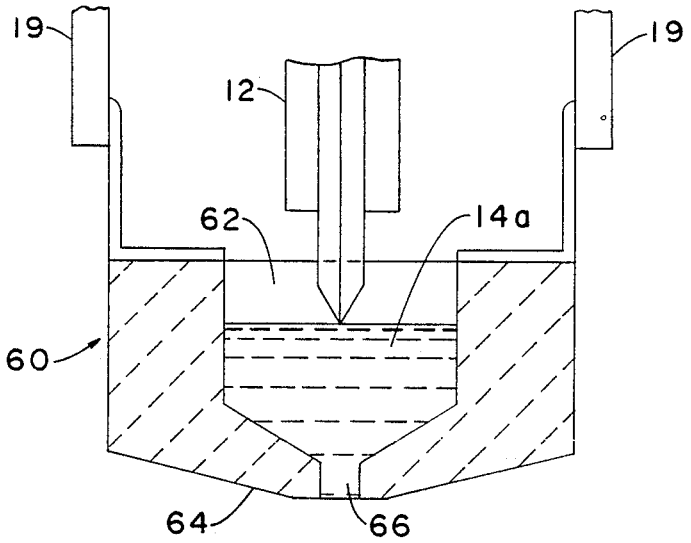
FIG. 4 is a sectional view of a boat-like structure for dampening changes occurring in the level of the molten body relative to the wheel of FIG. 1.

To minimize the possibility of changes in the upper level of molten stream 14 occurring at a rate greater than the system's ability to react to the changes, which changes may include both absolute changes in level, as well as undulations (waves) occurring in the upper surface, a structure or combination of structures can be provided to create a relatively quiescent pool 14*a* (FIG. 4) of molten metal for sampling. Such structures would include baffles disposed cross wise of the molten stream and/or a relatively small auxiliary trough located to receive molten metal from main trough 15. Both devices would slow the motion of abrupt absolute changes in metal level and dampen undulations in the upper surface of the metal.

A damping means that also provides fresh metal to sampling wheel 12 is preferred, as fresh metal makes the analysis process a truer indication of metal composition since sampling is not limited to one area of the totality of the stream. A structure 60 that provides both functions is shown in section in FIG. 4 of the drawings. The structure is located beneath wheel 12, and is an open top, hollow vessel defining a chamber 62 and having a bottom wall 64. An elongated narrow slot 66 is provided in the bottom wall.

Damping structure 60 is shown attached to platform 16, via depending panels 19, such that when the sampling wheel is lowered to the molten stream, structure 60 enters the stream ahead of the wheel, and molten metal flows up through slot 66 to form a small, generally quiescent pool 14*a* of molten metal beneath the wheel. The area of slot 66 relative to that of chamber 62 is such that abrupt changes and waves in the upper level of stream 14 are slowed or reduced in chamber 62. The amount of the slowing or reduction is dependent upon the ratio of the areas of the slot and chamber.

Boat-like structure 60 serves to present fresh metal to the sampling wheel each time it enters the molten stream. The surface tension of the molten metal is such that a substantial force is required for structure 60 to enter the metal. When the surface tension is broken, the molten metal pops through slot 66 and into chamber 62. Depending upon the alloy of the metal being sampled, the breaking of the surface tension can be effective in presenting metal to the wheel that is representative of the entire stream, thereby making analysis of the metal of the stream a truer indication of the metal's composition.

A material that has been found suitable for the structure of damper 60 is Maronite, a heat-resistant and inert material (in molten metal) made by Manville Company of Bellerica, Mass.

Figure 5:
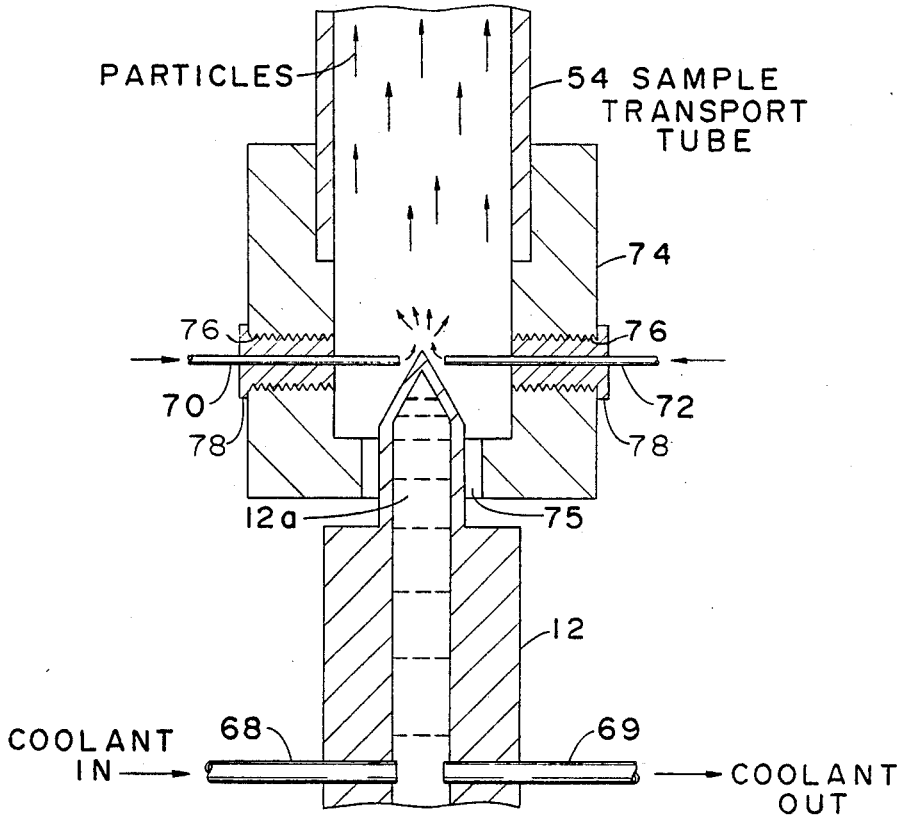
FIG. 5 shows means in partial section for removing metal particles formed on the periphery of the wheel when the wheel rotates out of the body of molten metal.
Figure 6:
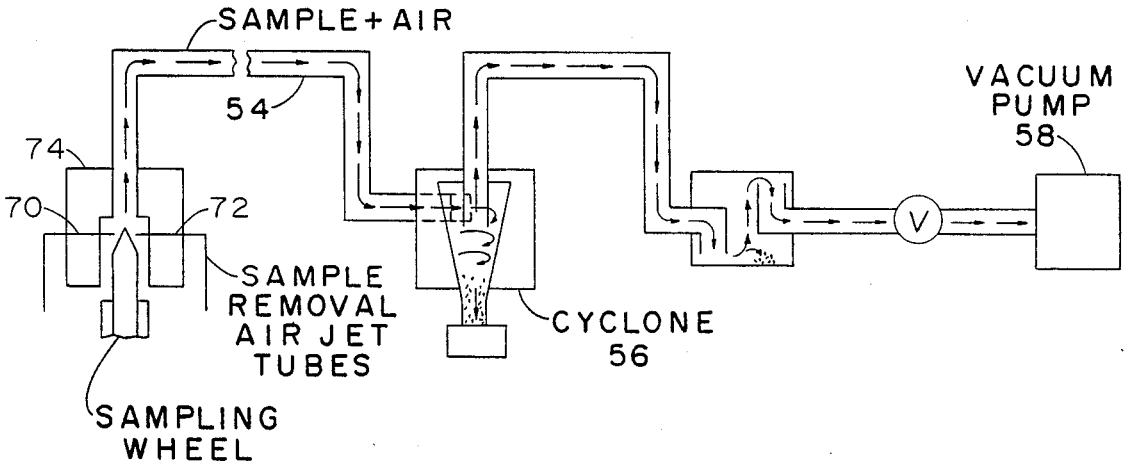
FIG. 6 is a schematic representation of a vacuum system for transporting the particles from the wheel to means for collecting the particles.

To promote rapid freezing of the molten metal on serrations 17, wheel 12 is shown cooled in FIG. 5 by a suitable coolant directed into a hollow interior 12*a* of the wheel. The coolant is directed into one side of the wheel by a conduit 68, connected to the wheel at the location of its axis of rotation, and removed from the wheel by a second conduit 69 connected to the side of wheel 12 opposite conduit 68. Conduits 68 and 69 are connected to the wheel by fittings (not shown), such as rotary joints or unions, that allow the wheel (and gear 46) to rotate while the conduits remain rotationally fixed. The rate of flow of the coolant to and from the wheel is such that hollow interior 12*a* is substantially filled with coolant while the wheel is sampling molten metal. The coolant is preferably circulated to and from the wheel by and through a suitable recirculating chiller (not shown) that removes from the coolant the heat that it acquires from the wheel.

When the serrations 17 of the sampling wheel rotate out of metal stream 14 in the sampling process, the molten metal that freezes on the serrations in the form of metal flakes separate from the serrations under centrifugal force. The separation occurs over a substantial distance about the periphery of the wheel so that it is difficult to collect the flakes in an efficient manner. To this end, the present invention includes the structure and process depicted in FIG. 5 of the drawings. More particularly, a high velocity flow of a gas medium under suitable pressure is directed to the serrations by two tubes 70 and 72 having ends located on opposite sides of the wheel and perpendicular to the plane of the wheel. The velocity of the flow of the medium striking the serrations is sufficient to remove the flakes at the one peripheral location of the tubes so that the flakes can be efficiently collected at such one location.

To receive the flakes at the location of tubes 70 and 72, a housing 74 is shown in FIG. 5 located about the ends of the tubes and closely adjacent and about the periphery of wheel 12. Openings 76 are provided in the sides of the housing to accommodate tubes 70 and 72. The tubes are connected to a source of the medium (not shown) located externally of the housing. Openings 76 are shown closed by bushings 78 threaded into the openings.

Housing 74, in turn, is provided with slot 75, through which the wheel rotates, and is connected to pipe 54 (FIG. 6) so that a gas stream created therein by vacuum pump 58 is effective to provide a flow of gas (air) through housing 74 and about the serrations of the wheel. The size of slot 75, i.e., the spaces between the sides of wheel 12 and the surfaces of housing 74 facing the wheel are such that the velocity of air flow in the slot is greater than the terminal velocity of the flakes removed from the wheel. In this manner, the flakes are entrained in the housing by the air flow drawn through the slot. Thus, the flakes, dislodged from the wheel by the flow of the medium from tubes 70 and 72, and by centrifugal force, are entrained and pulled through the housing, and from the housing into tube 54, as air is drawn through slot 75 and into tube 54. In this manner, the flakes formed on serrations 17 are captured at the location of tubes 70 and 72.

While the invention has been described in terms of preferred embodiments, the claims appended hereto are intended to encompass all embodiments which fall within the spirit of the invention.

What is claimed is:

1. Apparatus for making metal flakes comprising:
a wheel having serrations on its periphery,
means for rotating said wheel in a vertical plane,
means for controlling the relative positions of the wheel and an upper surface of a body of molten metal such that the serrations on the bottom of a wheel are disposed a preselected distance into said body of molten metal to collect molten metal on the serrations for freezing into solid flakes when the serrations rotate out of the molten metal,
means for removing the flakes from the serrations,
means for imposing an electrical potential between the wheel and molten metal body to determine whether the wheel is contacting the molten metal body, and
means for moving the wheel incrementally up and down into and out of the body of molten metal.

2. Apparatus as set forth in claim 1 in which the means for imposing the electrical potential includes an electrically conductive probe located to contact the upper surface of the molten body before the wheel contacts the molten body when the probe and wheel are moved toward the body.

3. Apparatus as set forth in claim 1 in which the means for moving the wheel up and down is adapted to be moved in increments of approximately 0.0005 inch.

4. Apparatus as set forth in claim 1 which is adapted to hold the wheel in the metal of the molten body approximately 100 milliseconds.

5. Apparatus as set forth in claim 1 including a probe for sensing excessive depth of the wheel in the pool of molten metal.

6. Apparatus as set forth in claim 1 in which the serrations are coated with a noble metal which resists oxidation.

7. Apparatus as set forth in claim 1 in which the serrations are coated with gold.

8. Apparatus as set forth in claim 1 in which the means for removing the flakes from the serrations includes two tubes disposed on opposite sides of the serrations for directing two gas streams perpendicularly to the plane of the wheel.

9. Apparatus as set forth in claim 1 which includes a housing disposed closely adjacent and about the serrations for receiving flakes of metal, and a conduit connected to the housing to conduct the flakes received in said housing to apparatus for analyzing the flakes.

10. Apparatus as set forth in claim 1 including a wave dampening means comprising a boat-like structure located beneath the wheel, said structure providing a chamber for receiving molten metal and having an opening in a lower wall of said structure to allow molten metal to enter said chamber.

11. Apparatus as set forth in claim 10 in which the respective areas of the chamber and lower opening are related in a manner that provides maximum dampening of surface waves in the molten metal.

12. Apparatus for making metal flakes comprising:
a wheel having serrations on its periphery,
means for rotating said wheel in a vertical plane,
means for imposing an electrical potential between the wheel and a molten body to determine whether the wheel is contacting the molten body,
means for moving the wheel incrementally up and down into and out of the molten body to control the relative positions of the wheel and an upper surface of the body of molten metal,
said means for imposing the electric potential including an electrically conductive probe located to contact the upper surface of the molten body before the wheel contacts said surface when the probe and the wheel are moved toward the body, and
two tubes disposed on opposite sides of the serrations for directing two gas streams perpendicularly to the plane of the wheel to remove metal flakes from the serrations when the serrations are rotated out of the body of molten metal.

13. Apparatus for making metal flakes comprising:
a wheel having serrations on its periphery,
means for rotating said wheel in a vertical plane,
means for moving the wheel incrementally up and down into and out of a molten body in increments of approximately 0.0005 inch and an electrically conductive probe located to contact the upper surface of the molten body before the wheel contacts the molten body when the probe and wheel are moved toward the body to accommodate changes occurring in the elevation of the upper surface of a body of molten metal so that serrations on the bottom of a wheel are disposed and maintained at a preselected distance in said body to collect molten metal on the serrations,
means for dampening waves and abrupt changes occurring in the upper level of the body of molten metal,
means for removing flakes from the serrations, and
means disposed closely adjacent to and about the serrations and at the location of the means for removing flakes from the serrations for receiving the flakes removed from the serrations.

14. A method of making metal flakes comprising:
providing a body of molten metal,
providing a wheel having serrations on its periphery,
controlling the relative positions of the wheel and an upper surface of said body of molten metal to dispose the serrations on the bottom of the wheel a preselected distance into the upper surface of the molten metal, rotating said wheel in a vertical plane to collect molten metal on the serrations which freezes into solid flakes when the serrations are rotated out of the molten metal, removing the flakes from the serrations, incrementally moving the wheel up and down and into and out of the body of molten metal, and imposing an electrical potential between the wheel and molten metal to determine when the wheel contacts the molten metal.

15. The method of claim 14 including moving the wheel up and down in increments of approximately 0.0005 inch.

16. The method of claim 14 including holding the wheel in the body of molten metal approximately 100 milliseconds.

17. The method of claim 14 including locating a boat-like structure having an opening in a lower wall of the structure beneath the wheel to effect dampening of the waves in the upper surface of the molten metal.

18. The method of claim 14 including:

directing two streams of gas respectively against the sides of the serrations and perpendicular to the plane of the wheel to effect removal of the flakes from the serrations.

19. The method of claim 18 including:

providing a housing closely adjacent to and about serrations of the wheel, and at the location at which the streams of gas are directed to the serrations, and receiving in said housing flakes of metal removed from the serrations by the streams of gas.

20. The method of claim 19 including conducting the flakes from the housing to a location for analyzing the flakes.

21. The method of claim 14 including electrically sensing excessive depth of the wheel in the pool of molten metal, and raising the wheel from the pool when excessive depth is sensed.

22. A method of making metal flakes comprising:

providing a body of molten metal having an upper surface subject to changes in elevation, providing a wheel having serrations on its periphery, rotating said wheel in a vertical plane, controlling the relative positions of the wheel and changing elevation of the upper surface such that serrations on the bottom of the wheel are disposed and maintained a controlled distance in the body of molten metal, said control being effected by incrementally moving the wheel up and down and into and out of the molten metal, imposing an electrical potential between the wheel and molten metal to determine when the wheel contacts the molten metal, and dampening abrupt changes and waves occurring in the upper surface of the metal.

23. A method of making metal flakes comprising:

providing a body of molten metal having an upper surface, providing a wheel having serrations on its periphery, rotating said wheel in a vertical plane, incrementally moving the wheel up and down and into and out of the body of molten metal in increments of 0.0005 inch, providing a probe to impose an electrical potential between the wheel and molten metal to determine when the wheel contacts the molten metal, and dampening waves and abrupt changes occurring in the upper surface of the molten metal by disposing a boat-like structure beneath the wheel such that a lower opening in said structure admits molten metal to the wheel when said structure is moved into the body of molten metal.

* * * * *